United States Patent [19]

Shalgi et al.

[11] Patent Number: 4,836,416

[45] Date of Patent: Jun. 6, 1989

[54] FLEXIBLE CONTAINER WITH STOPPER VALVE

[75] Inventors: Asaf Shalgi, Kibbutz Nachshon; Juval Limon, Tel Aviv, both of Israel

[73] Assignee: Aran Arizot Nachshon, Shimshon, Israel

[21] Appl. No.: 82,089

[22] Filed: Aug. 5, 1987

[30] Foreign Application Priority Data

Jan. 8, 1987 [IL] Israel ..... 81210

[51] Int. Cl.[4] ..... A45F 3/20; B65D 37/00; B67D 3/00

[52] U.S. Cl. ..... 222/48; 222/105; 222/175; 222/183; 222/520; 222/543; 224/215; 224/148; 383/906

[58] Field of Search ..... 222/105, 107, 129, 175, 222/183, 94, 519–525, 41, 47, 48, 543; 224/148, 153, 209, 215; 383/37–40, 89–91, 109, 113, 906

[56] References Cited

U.S. PATENT DOCUMENTS

| | | | |
|---|---|---|---|
| 1,509,431 | 9/1924 | Ittner | 222/520 |
| 2,013,358 | 9/1935 | Osborne | 222/175 X |
| 2,324,194 | 7/1943 | Campiglia | 224/215 |
| 2,618,800 | 11/1952 | Raab | 222/546 X |
| 2,750,084 | 6/1956 | Moran | 222/520 X |
| 2,998,170 | 8/1961 | Manzione | 222/520 |
| 3,033,428 | 5/1962 | Van Baarn | 222/520 X |
| 3,059,821 | 10/1962 | Kubiliunas | 222/520 |
| 3,140,799 | 7/1964 | Mehr | 222/519 X |
| 3,232,499 | 2/1966 | Esposito, Jr. | 222/520 X |
| 3,370,764 | 2/2968 | Stull | 222/521 X |
| 3,525,454 | 8/1970 | Frederiksen | 220/359 |
| 3,834,596 | 9/1974 | Brady et al. | 222/520 |
| 3,887,116 | 6/1975 | Ishikawa et al. | 222/520 |
| 4,011,961 | 3/1977 | Widen et al. | 215/232 |
| 4,096,978 | 6/1978 | Noice | 224/215 |
| 4,193,518 | 3/1980 | Holmes | 222/105 |
| 4,207,988 | 6/1980 | Prouty et al. | 215/232 |
| 4,220,267 | 9/1980 | Gegenhuber | 222/520 |
| 4,261,487 | 4/1981 | Seager | 222/520 |
| 4,332,379 | 6/1982 | Bannister | 224/215 X |
| 4,362,255 | 12/1982 | Bond | 222/107 |
| 4,445,550 | 5/1984 | Davis et al. | 222/105 X |
| 4,480,769 | 11/1984 | Tellini | 222/519 |
| 4,494,663 | 1/1985 | Bertaud et al. | 215/232 |
| 4,568,004 | 2/1986 | Goncalves | 222/520 X |
| 4,595,126 | 6/1986 | Holmes | 222/105 |

FOREIGN PATENT DOCUMENTS

| | | | |
|---|---|---|---|
| 833362 | 2/1970 | Canada | 222/520 |
| 0026055 | 3/1984 | European Pat. Off. . | |
| 33347 | 11/1969 | Israel . | |
| 44598 | 4/1974 | Israel . | |
| 457222 | 9/1974 | Israel . | |
| 49787 | 6/1976 | Israel . | |
| 306383 | 3/1933 | Italy | 222/520 |
| 84/00738 | 3/1984 | World Int. Prop. O. . | |

OTHER PUBLICATIONS

"Upstream" brochure–Waterpacks.

D. L. Johnson et al., "Improved Flexible Container for Fluids", Research Disclosure, No. 218, Jun. 1982, 210–211, Havant, Hampshire, GB.

*Primary Examiner*—Kevin P. Shaver

*Attorney, Agent, or Firm*—Cushman, Darby & Cushman

[57] ABSTRACT

A flexible container for liquid storage including a collapsible bag element enclosed within an outer bag and integrally formed with a neck defining an opening for liquid flow therethrough and a valve for controllably determining the flow rate of stored liquid through the neck including an outer cap, protrusions being formed both on the lower edge of the outer cap and on the upper edge of the neck and arranged such that rotation of the outer cap relative to the neck from a fully closed position to a flow position causes engagement of the protrusions and a user-sensible resistance to rotation.

17 Claims, 6 Drawing Sheets

FLEXIBLE CONTAINER WITH STOPPER VALVE

The present invention relates to liquid storage container design, more particularly to the design of portable flexible containers with stoppers which are resealable after pouring of contents therefrom.

BACKGROUND OF THE INVENTION

There are known portable liquid container designs which are adapted for military applications under field conditions. Well-known examples are the canteen and the portable jerrycan, which can be worn as part of a body harness and carried by a user in addition to other equipment. Where large amounts of liquid are to be carried or the other equipment is heavy, the weight of the liquid container itself together with the volume it occupies may be a significant factor which reduces the user's freedom of movement. Even when fully emptied of their contents, such conventional containers remain cumbersome if only because of their shape which does not collapse.

In addition to the weight problem, and important part of the container's usefulness is the ability to easily discharge its contents in a resealable fashion. Thus, the design of the container's stopper or cap becomes important. Under field conditions, there is a concern for hygienic use of drinking supplies, and repeated removal of a canteen cap, for example, may allow dirt to enter or to interfere with the proper closing of the screw-on cap. There is also the possibility that the cap may become separated from the container during frequent use. Refilling the container is of overall importance in the design of the container stopper since a maximum opening allows this operation to be completed in the shortest amount of time.

Therefore, it would be desirable to provide a portable container for liquid storage which is lightweight, uses a resealable stopper and is collapsible to conserve volume once emptied.

SUMMARY OF THE INVENTION

Accordingly, it is a principal object of the invention to overcome the above-mentioned disadvantages and provide a lightweight portable container for liquid storage which is collapsible in use and is easily resealable once the container contents have been partially or fully emptied.

According to the invention, there is provided a flexible container for liquid storage, the container comprising:

a collapsible bag element enclosed within an outer bag and integrally formed with a substantially circular neck defining an opening for liquid flow therethrough, the interior of the neck having a recessed annular lip formed at the top end thereof; and valve apparatus for controllably determining the flow rate of stored liquid through the neck, the valve apparatus comprising a substantially cylindrical outer cap and an inner valve plug retained in a centrally located opening thereof, the inner valve plug being shaped to form at least one surface flow channel adjacent thereto, the outer cap adapted for engaging the exterior of the neck in respective shut-off and flow positions wherein the inner valve plug is respectively seated on and spaced apart from the recessed annular lip for blocking and enabling liquid flow through the neck opening, enabled liquid flow continuing through the at least one adjacent surface flow channel for discharge through the central opening in the outer cap.

In a preferred embodiment, the flexible bag element is a multi-layered sealed plastic laminate bag which may or may not be metallized. An exterior-thread plastic neck defining the liquid filling spout is heat sealed into an opening in the bag. The entire arrangement is enclosed within an outer durable cloth bag such as that used for construction of backpack camping equipment.

The controllable liquid flow rate is provided in accordance with the invention by a specially designed stopper valve which operates in shut-off ans flow positions depending on the degree of engagement with the neck. For this purpose, the stopper valve has a matched interior thread for engaging the neck. The top end of the stopper valve has a tubular pouring spout within which an inner valve plug is retained centrally so as to face the bottom end of the stopper valve. The inner valve plug is shaped with partitions forming flow channels adjacent to its surface.

When the stopper valve thread engages the neck in the shut-off position, the inner valve plug is seated on the recessed lip of the neck, blocking the flow of stored liquid through the tubular pouring spout. When the stopper valve is rotated open such that its interior thread engages the neck in a flow position, the inner valve plug is retracted from the lip and permits stored liquid to flow around it through the adjacent surface flow channels and then out through the tubular pouring spout. The flow rate in dependent upon the amount of rotation which determines the size of the opening between the inner valve plug and the recessed lip.

A feature of the invention is the provision of straps for securing the outer backpack bag enclosing the flexible container to the user's body.

Another feature of the invention is the provision of constriction belts for adjusting the shape of the flexible bag so as to force the stored fluid to move upwards towards the neck as the bag contents are emptied.

Still another feature of the invention is the provision of the outer backpack bag with a fabric partition for creating multiple compartments for storage of personal effects and use of the outer backpack bag as a regular backpack once the flexible bag has been emptied.

Additional features of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which.

DETAILED DESCRIPTION OF A PREFERRED EMBODIMENT

Figure 1:
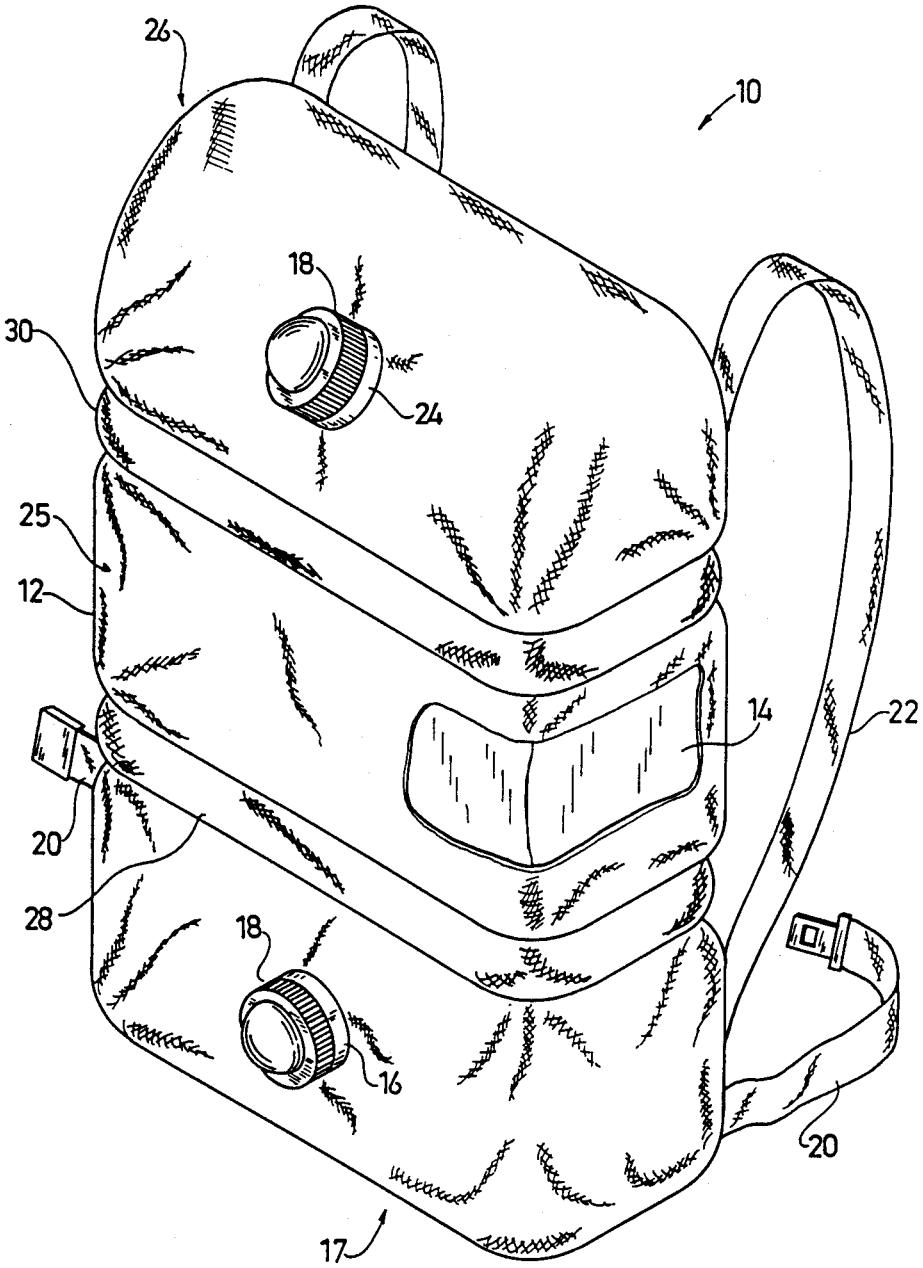
FIG. 1 is a perspective view of a flexible container constructed and operative in accordance with the principles of the present invention.

Referring now to FIG. 1, there is shown a perspective view of the flexible container of the present invention in a backpack construction 10. Visible in this figure are an outer bag 12 of a durable material such as Cordura, a trademark of the DuPont Corporation (U.S.A.), or other high-strength nylon which is shaped as an enclosed package. Contained within outer bag 12 is a flexible bag 14 (shown in partial cutaway view) which has an integrally formed neck portion 16 at its lower end 17 which is shown covered by a specially designed stopper valve 18. Flexible bag 14 is made of a multilayer sealed plastic laminate material which may or may not be metallized. Neck portion 16 is cylindrical and is typically made of a rigid plastic material such as polyethylene.

As described further herein, flexible bag 14 can be filled with a liquid for storage purposes, and can be emptied through neck portion 16 at a flow rate which is fully controllable by the specially designed stopper valve 18.

The outer bag 12 can be strapped to a user's body as a backpack by means of a fastening strap 20. In addition, a shoulder harness 22 can be used to provide further stability when the backpack construction 10 is carried by the user.

As will be appreciated by those skilled in the art, many variations on the design of outer bag 12 shown in FIG. 1 are possible. For example, the outer bag 12 may be shaped differently or vary in size, and it may be enclosed by a zipper which allows for storage of other materials therein. The volume of the flexible bag 14 may be designed with graduations in a typical range of 2, 3, 5, 10 and 20 liters, for example.

As shown in FIG. 1, the backpack construction 10 provides the flexible bag 14 with a second neck portion 24 in the midsection 25 of outer bag 12. This is useful when flexible bag 14 has been half emptied of its contents, and it is desired to shift the center of gravity to the upper end 26 of backpack 10 to afford the user with greater maneuverability. For this purpose, backpack 10 is provided with a plurality of constriction belts 28, 30 which can be fastened around the outer bag 12 and used to force the stored liquid to upper end 26 of backpack 10.

Referring now to FIGS. *2a–b*, there are shown sectional elevations of neck portion 16 and stopper valve 18 of flexible bag 14 (not shown) in respective shut-off and flow positions. The edges 32 of a circular opening 34 in flexible bag 14 circumferentially enclose the base 36 of neck portion 16 which is formed so as to be attachable to edges 32 by heat sealing techniques. Neck portion 16 extends vertically along its side wall 38 which provides support for an integrally formed shoulder 40 whereat the diameter of neck 16 narrows to a threaded cylindrical upper portion 42. The top end 44 of neck upper portion 42 defines an opening 46 and is formed with a recessed annular lip 48 which faces inwardly. A circumferential rib 47 is formed in the periphery of neck portion 42.

As illustrated in FIG. *2a*, stopper valve 18 comprises a cylindrical outer cap 50 having an integrally formed tubular pouring spout 52 extending vertically from its center as defined by centerline 54. An outer flap 55 anchored to outer cap 50 by ring 56 covers the open end 58 of spout 52 with a protective cap 59 which is secured by lip 57 to insure hygienic conditions when liquid is not being discharged from flexible bag 14. Lip 57 is also useful for securing connection of a flexible hose extension to spout 52.

Retained within the hollow interior of spout 52 is an inner valve plug 60 which is used to seal opening 46 and controllably determine the liquid flow rate therethrough. Inner valve plug 60 is designed with a conically shaped lower section 61 having a pair of stepped ridge-like edges 62 formed therein. Projecting vertically above lower section 61 and integrally formed therewith is a flanged stem 64.

In the preferred embodiment, flanged stem 64 comprises four adjacent orthogonal flanges 66*a–d*, with flange 66*a* extending to the left side of FIG. *2a*, flange 66*b* projecting out of the page, flange 66*c* extending to the right side of the figure and flange 66*d* (not visible) projecting into the page. Each of the four flanges 66*a–d* is respectively joined to one of four orthogonal vanes 68*a–d* which are located on surface 70 of inner valve plug 60. The structure of flanged stem 64 is shown in greater detail in FIGS. *5a–b*.

Also shown in FIG. *2a*, flanged stem 64 is centrally retained in the hollow interior of spout 52. For this purpose, each of flanges 66*a–d* is notched to match an annular locking rib 72 formed in the lower end of spout 52. When inner valve plug 60 is inserted into the hollow interior of spout 52 from below, a chamfered edge 74 of each of flanges 66*a–d* rides over locking rib 72 until locking engagement with the notches is obtained. This provides a secure connection between inner valve plug 60 and outer cap 50, while allowing them to be separated for cleaning purposes.

To provide the sealing feature of stopper valve 18, outer cap 50 of stopper valve 18 is provided with interior threads 75 matching those of neck upper portion 42 which permit it to become threadably engaged therewith by rotation. The amount of rotation raises and lowers stopper valve 18 on neck upper portion 42, and with this rotation inner valve plug 60 is likewise raised and lowered with respect to recessed annular lip 48.

It is a particular feature of the present invention that the liquid flow rate through opening 46 is fully controllable from shut-off to flow conditions by appropriate rotation of outer cap 50 of stopper valve 18. In operation, outer cap 50 is adjusted in a first instance to a shut-off position as shown in FIG. *2a*. In this position, the pair of ridge-like edges 62 are positively seated on recessed annular lip 48 of neck upper portion 42. Although even one edge 62 would suffice, edges 62 together provide a double seal of the contents of flexible bag 14 by blocking the flow of liquid through opening 46.

As illustrated in FIG. *2b*, when it is desired to discharge the contents of flexible bag 14, outer flap 55 is removed from the open end 58 of spout 52. This allows outer cap 50 to be rotated. When outer cap 50 is rotated open to a flow position (see arrow), inner valve plug 60 is raised relative to recessed annular lip 48. This enables the flow of liquid through opening 46 in the direction of the flow arrows 76. Liquid flow continues through the flow channels formed in surface 70 between adjacent orthogonal ribs 68*a–d*, then between adjacent orthogonal flanges 66*a–d* in stem 64, and finally out through open end 58 in spout 52. As outer cap is raised by rotation, circumferential rib 47 rides against inner wall 77 of outer cap 50 to provide a leakproof seal of the liquid contents.

The amount of rotation of outer cap 50 adjusts the spacing between inner valve plug 60 and recessed annular lip 48 and thereby maintains control over the rate of liquid flow through opening 46. In the preferred embodiment, a minimum of 180 degrees of rotation is required to move stopper valve 18 between the shut-off and flow positions. The flow position can be established by provision of a small protrusion 78 at a point in the lower edge of outer cap 50. A similar protrusion 80 formed in upper edge of shoulder 40 provides a slight turning resistance which is sensed when protrusions 78 and 80 engage as outer cap 50 is rotated open. As will be appreciated by those skilled in the art, the rotation requirement for the flow position may be changed.

As can be seen from the foregoing description, outer cap 50 is adjustable to three positions; a first position wherein opening 46 in neck 16 is entirely closed, a second, intermediate position wherein inner valve plug 60 is raised above opening 46 to permit controlled fluid outfow therethrough, and a filling position wherein outer cap 50 is entirely removed to allow refilling of flexible bag 14.

Figure 3:
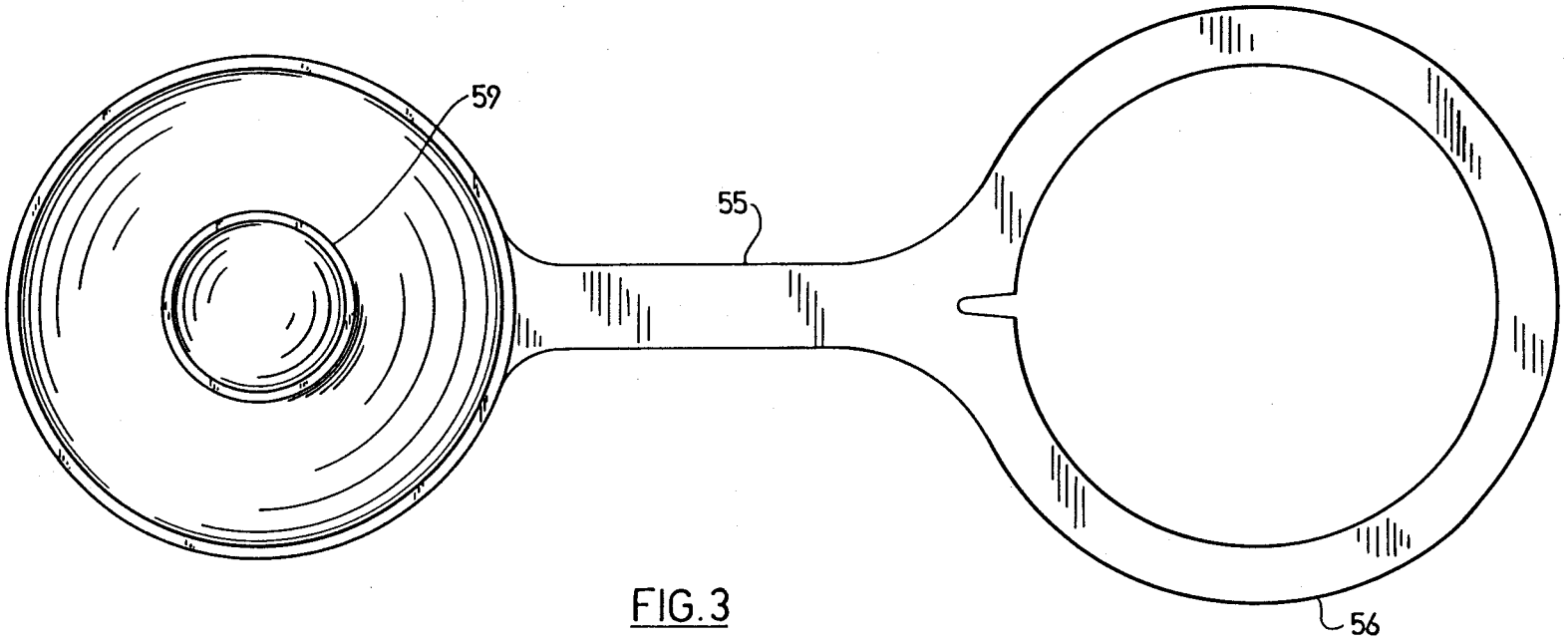
FIG. 3 illustrates the layout of a protective outer flap for covering the stopper valve of the flexible container.

FIG. 3 illustrates the layout of outer flap 55 from the underside and shows additional construction details of ring 56 and the dish-shaped protective cap 59.

Figure 4:
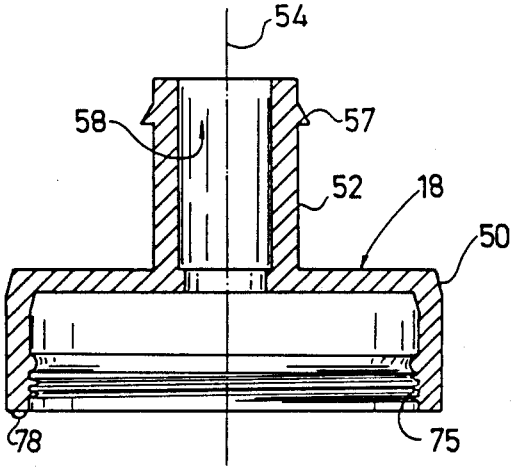
FIG. 4 is a sectional elevation of the outer cap of the stopper valve of FIG. 2.
Figure 5:
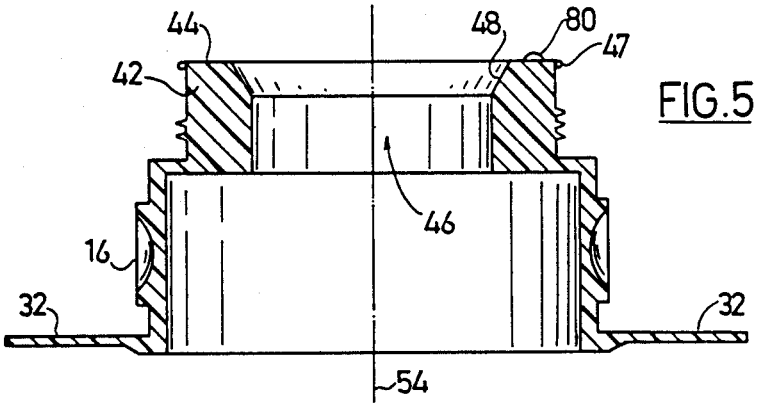
FIG. 5 is a sectional elevation of the neck of the flexible bag shown in FIG. 2.

FIGS. 4 and 5 illustrate respective sectional elevations of stopper valve 18 and neck portion 16 of flexible bag 14. Additional construction details are visible in these figures.

Figure 2A:
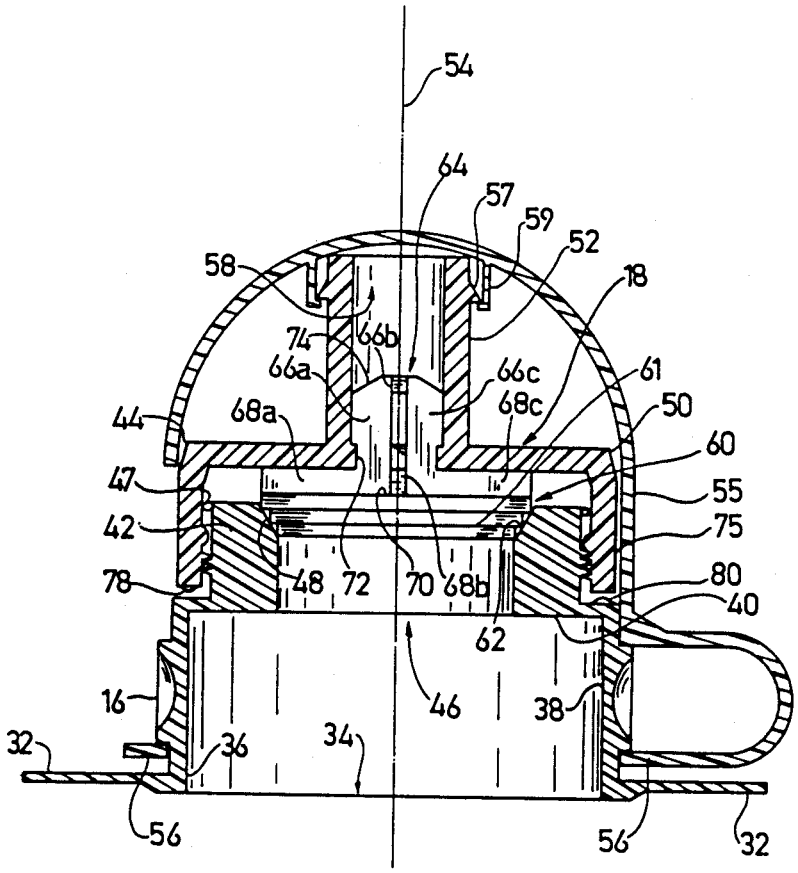
FIGS. 2*a–b* are respective sectional elevations of the stopper valve shown in the shut-off and flow positions on the neck of the flexible bag depicted in the embodiment of FIG. 1.
Figure 2B:
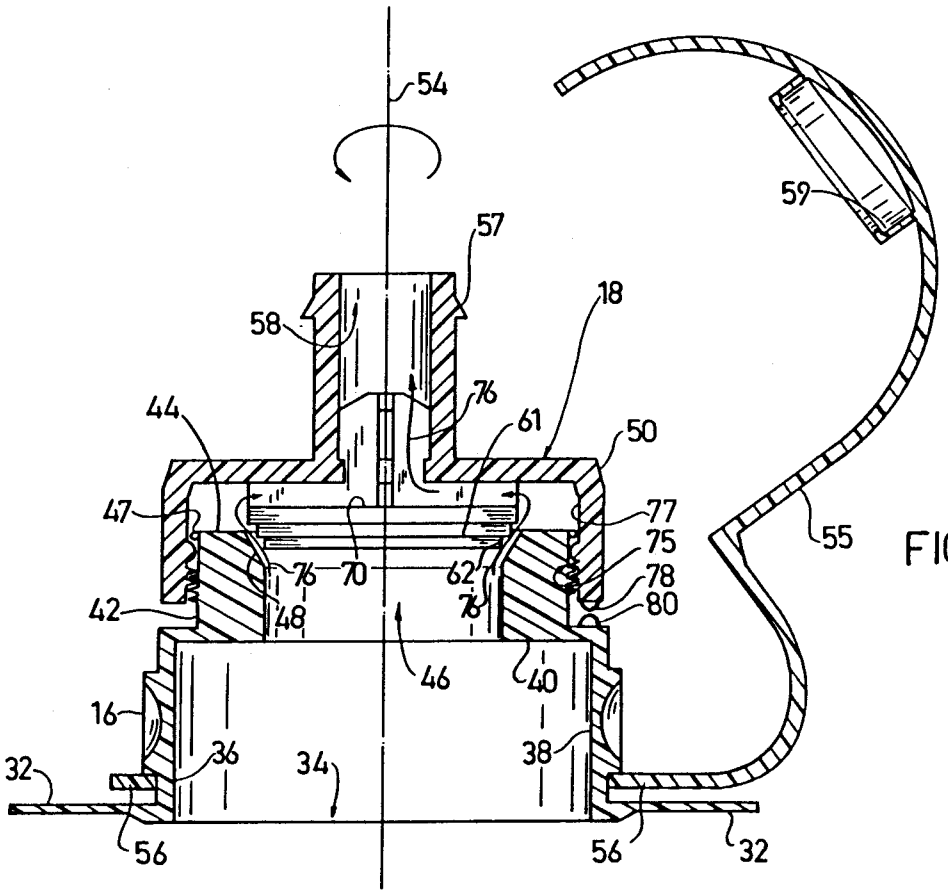
Figure 6A:
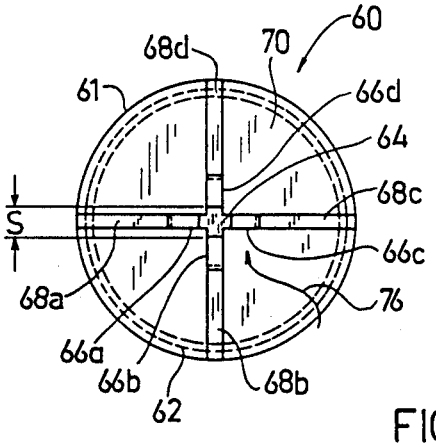
FIGS. 6*a–b* show respective top and side views of the inner valve plug operative with the stopper valve of FIG. 2.
Figure 6B:
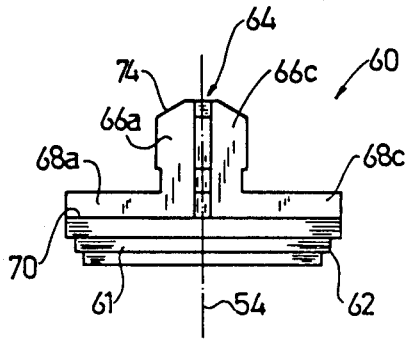

FIGS. 6*a–b* illustrate respective top and side views of inner valve plug 60 of the present invention. Additional construction details are visible in these figures. Inner valve plug 60 may be formed as an integral shape by injection molding of thermoplastic material. Of particular importance in the shaping of inner valve plug 60 are the adjacent orthogonal flanges 66*a–d* and adjoining orthogonal vanes 68*a–d*. These are provided to partition surface 70 into adjacent surface flow channels for conducting the flow of liquid from the underside of inner valve plug 60 along the path shown by the flow arrows 76 in FIG. 2*b*. The dimension S is shown as the width of the top end of flanged stem 64 between the points where the chamfered edges 74 begin.

In summary, the flexible container construction of the present invention provides a lightweight portable user-oriented means for carrying liquids. The volume of the container is collapsible after use, making the flexible container easy to store by folding once used. Designed as a backpack, the flexible container adapts itself to the user's body and requires no independent support frame. The liquid carried by the flexible container may be a drinking supply, or it could be a liquid useful in field use such as fuel or oil. The inner flexible bag may be replaced if necessary after repeated, prolonged use.

While the principles of the invention have been described with regard to specific embodiments, it is to be understood that the description is made by way of example only and not as a limitation on the scope of the invention, which is set forth in the appended claims.

We claim:

1. A flexible container for liquid storage, said container comprising:

a collapsible bag element enclosed within an outer bag and integrally formed with a substantially circular neck defining an opening for liquid flow therethrough, the interior of said neck having a recessed annular lip formed at the top end thereof; and valve means for controlling the flow rate of stored liquid through said neck, said valve means comprising a substantially cylindrical outer cap and an inner valve plug retained in a centrally located opening thereof, said inner valve plug being shaped to form at least one surface flow channel adjacent thereto said outer cap and said neck having respective matching interior and exterior threads for providing shut-off and flow positions upon rotation of said outer cap, wherein said inner valve plug is respectively seated on and spaced apart from said recessed annular lip for blocking and enabling liquid flow through said at least one adjacent surface flow channel for discharge through the central opening in said outer cap, said flexible container being further characterized in that protrusions are formed both on the lower edge of said outer cap and on the upper edge of said neck and arranged such that rotation of said outer cap relative to said neck from a fully closed position to a flow position causes engagement of said protrusions and a user-sensible resistance to rotation.

2. The flexible container of claim 1 wherein said neck is heat sealed into an opening in said collapsible bag element.

3. The flexible container of claim 1 wherein a circumferential rib is formed on the periphery of the upper end of said neck, said circumferential rib being maintained in sliding contact with the inner wall of said outer cap and providing a leakproof seal therbetween as said outer cap is rotated open.

4. The flexible container of claim 1 wherein said valve means engages said neck in the flow position after a minimum of 180 degrees rotation of said valve means from the shut-off position.

5. The flexible container of claim 1 wherein the liquid flow rate in said flow position is fully controllable dependent upon the amount of rotation of said valve means to determine the size of the opening between the inner valve plug and the recessed annular lip.

6. The flexible container of claim 1 wherein said collapsible bag element comprises a multi-layered sealed plastic laminate bag.

7. The flexible container of claim 6 wherein said neck is heat sealed into an opening in said collapsible bag element.

8. The flexible container of claim 1 wherein there is formed a tubular pouring spout projecting from said central opening in said outer cap.

9. The flexible container of claim 8 wherein said inner valve plug is integrally formed with a lower section having a plurality of ridge-like sealing edges on its outer surface and a flanged stem projecting from its upper surface, said flanged stem comprising four adjacent orthogonal flanges and adjoining vanes forming partitioned adjacent surface flow channels in said upper surface.

10. The flexible container of claim 9 wherein the lower interior end of said tubular pouring spout has an annular locking rib formed therein and said flanged stem has a chamfered edge and notch formed on the upper end of each of said four adjacent orthogonal flanges, said locking rib engaging said flanged stem notches when said inner valve plug is inserted into said spout lower end for providing a secuure, separable connection therebetween.

11. The flexible container of claim 1 wherein said outer bag is fabricated of a durable cloth material such as that used for construction of backpack camping equipment.

12. The flexible container of claim 11 further comprising a fabric partition for creating multiple compartments within the outer backpack bag for storage of personal effects and use of the outer backpack bag as a regular backpack once the collapsible bag has been emptied.

13. The flexible container of claim 11 further comprising constriction belts for adjusting the shape of the collapsible bag element so as to force the stored fluid to move upwards towards the neck as the bag contents are emptied.

14. The flexible container of claim 13 further comprising a fabric partition for creating multiple compartments within the outer backpack bag for storage of personal effects and use of the outer backpack bag as a regular backpack once the collapsible bag has been emptied.

15. The flexible container of claim 11 further comprising straps for securing the outer backpack bag enclosing the flexible container to the user's body.

16. The flexible container of claim 15 further comprising constriction belts for adjusting the shape of the collapsible bag element so as to force the stored fluid to move upwards towards the neck as the bag contents are emptied.

17. The flexible container of claim 15 further comprising a fabric partition for creating multiple compartments within the outer backpack bag for storage of personal effects and use of the outer backpack bag as a regular backpack once the collapsible bag has been emptied.

* * * * *